United States Patent [19]

Evans

[11] 4,262,758

[45] Apr. 21, 1981

[54] BOREHOLE ANGLE CONTROL BY GAGE CORNER REMOVAL FROM MECHANICAL DEVICES ASSOCIATED WITH DRILL BIT AND DRILL STRING

[76] Inventor: Robert F. Evans, 631 Honeywood La., La Habra, Calif. 90631

[21] Appl. No.: 101,853

[22] Filed: Dec. 10, 1979

Related U.S. Application Data

[62] Division of Ser. No. 928,703, Jul. 27, 1978, Pat. No. 4,211,292.

[51] Int. Cl.[3] ..... E21B 9/34

[52] U.S. Cl. ..... 175/73; 175/267; 175/292

[58] Field of Search ..... 175/61, 73, 76, 93, 175/339, 380, 398, 325, 267, 273, 292, 384, 336

[56] References Cited

U.S. PATENT DOCUMENTS

| | | | |
|---|---|---|---|
| 2,317,010 | 4/1943 | Wingard | 175/398 |
| 2,859,941 | 11/1958 | Carroll et al. | 175/336 |
| 3,092,188 | 6/1963 | Farris et al. | 175/61 |
| 3,142,347 | 7/1964 | Barnes | 175/349 |
| 3,825,081 | 7/1974 | McMahon | 175/73 |
| 3,903,974 | 9/1975 | Cullen | 175/73 |
| 4,015,673 | 4/1977 | Craig, Jr. et al. | 175/61 |

*Primary Examiner*—James A. Leppink
*Attorney, Agent, or Firm*—John R. Ley

[57] ABSTRACT

The advancement angle of a borehole cut by a rotary drill bit of the type which forms a cylindrical sidewall, a drill face and a circumferentially extending gage corner, is controlled by removing a different amount of the gage corner material over a selected partial arc of the gage corner circumference during each rotation of the drill bit. The different amount of material removed causes the remaining arc of the gage corner circumference to apply a slight lateral force on the drill bit, thus forcing the drill bit in a desired direction. Gage corner removal apparatus include selectively extendable cutter devices, a hinged connector hingeably connecting the drill bit to the end of the drill string, and a pivotable single cutting wheel member. Selectively activating the gage corner removal apparatus during each of a plurality of subsequent drill bit revolutions results in a cumulative angle change effect. Control apparatus is attached to the drill string at a position at which gravity induced sag causes the drill string to contact the low side portion of the borehole. The control apparatus is arranged for deriving energy from contact and rotation of the drill string relative to the low side portion. The energy derived activates the gate corner removal apparatus.

21 Claims, 16 Drawing Figures

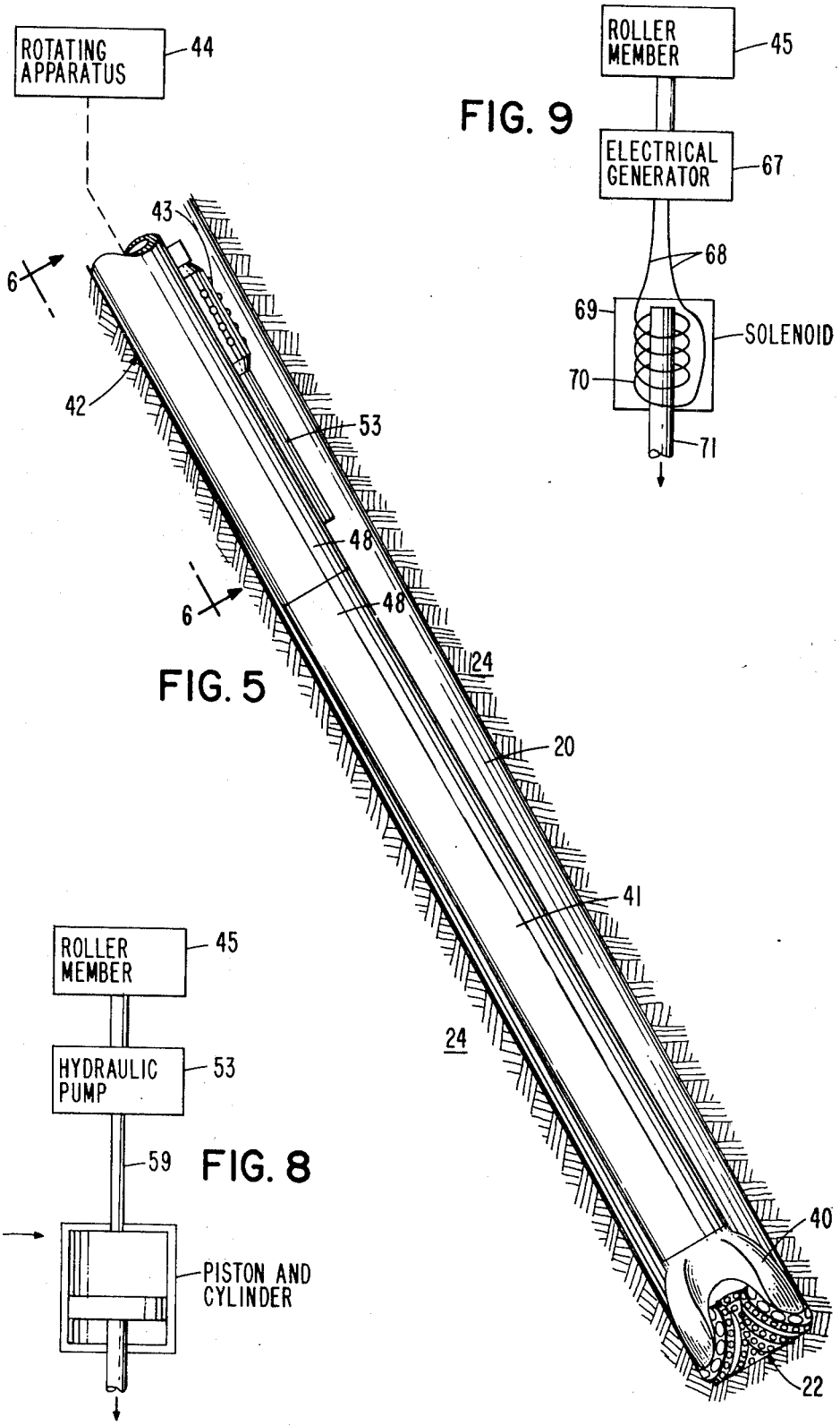
FIG. 5
FIG. 9
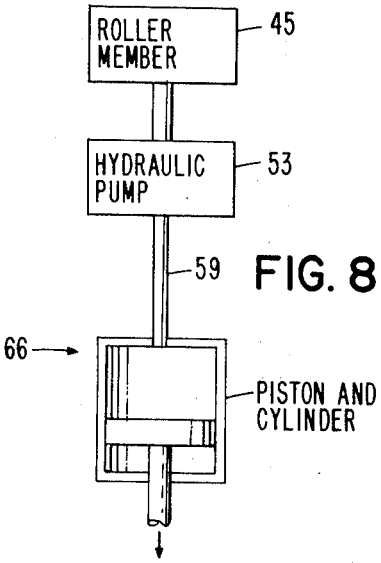
FIG. 8

FIG. 15
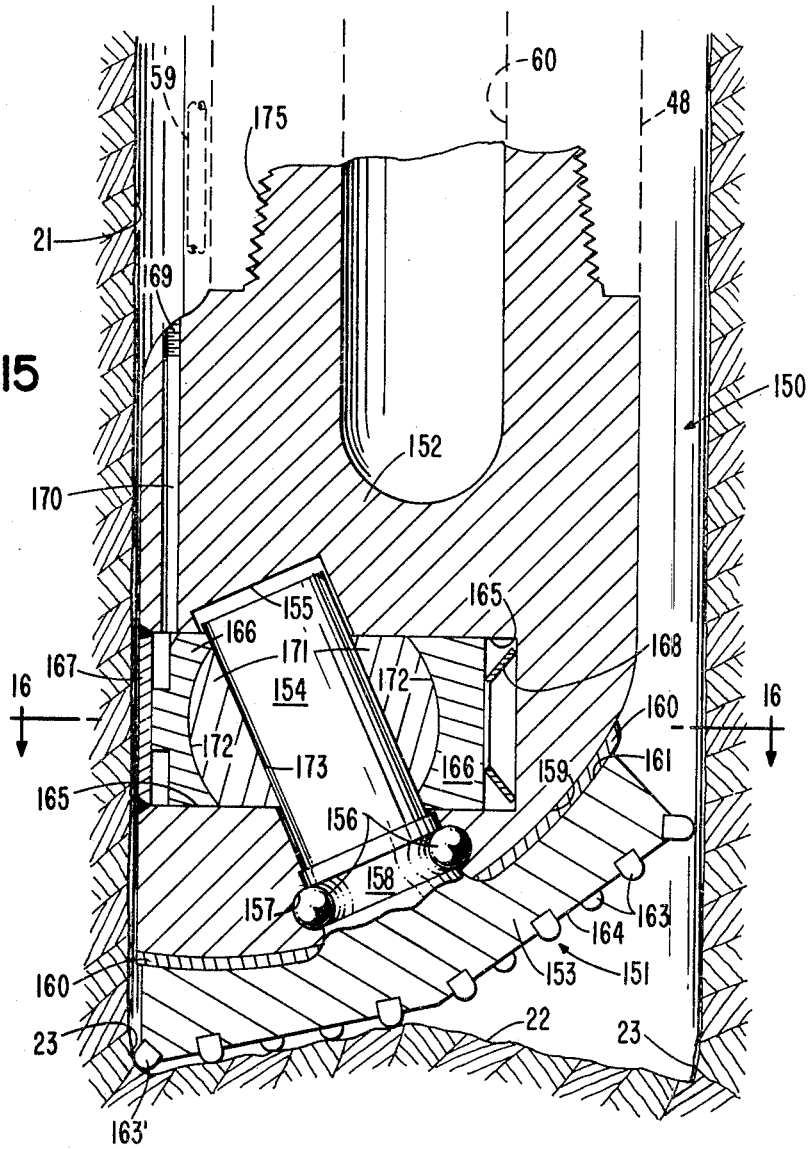
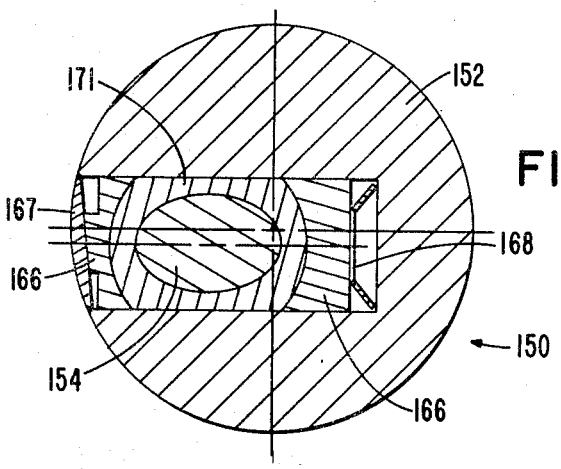
FIG. 16

BOREHOLE ANGLE CONTROL BY GAGE CORNER REMOVAL FROM MECHANICAL DEVICES ASSOCIATED WITH DRILL BIT AND DRILL STRING

CROSS REFERENCE TO RELATED PATENT APPLICATION

This is a division of U.S. patent application Ser. No. 928,703, filed July 27, 1978, which is now issued as U.S. Pat. No. 4,211,292.

BACKGROUND OF THE INVENTION

1. Field of the Invention

This invention relates to and is useful for selectively controlling the angle of a well hole or a borehole as it is cut through earth material or the like. More particularly, the present invention relates to controlling the advancement angle of a borehole by selectively removing a different amount of material over a selected partial arc of a gage corner formed by a rotary drill bit.

2. Brief Introduction and Description of Prior Art

A variety of different methods and arrangements to control the advancement angle of a borehole are known and conventionally employed. Although the majority of these approaches are successful and reliable, certain disadvantages are inherent. Usually, changing or controlling the borehole deviation or advancement angle requires use of special drill bits, support collars, and special methods of drilling. In each case, the conventional drill bit and drill string must be pulled from the borehole and the special equipment inserted. After achieving the desired angle change, the special equipment is removed and use of the conventional equipment is resumed. Of course, each time an angle change is made, there is an obvious loss of drilling penetration rate while the special equipment is inserted, used and then removed. Control and guidance equipment is typically required for conventional angle change apparatus and methods and this equipment is generally very expensive and may require the presence of specially trained personnel to operate and control the equipment. Since a major factor in drilling well holes is time consumed, it is important to maintain a good drilling or penetration rate and to minimize the time when actual drilling does not proceed. Reducing the costs involved in making angle changes with conventional equipment is a further important factor in reducing the total cost of drilling boreholes.

Other disadvantages and limitations are known and appreciated by those knowledgeable in the art. Many of these prior art disadvantages and limitations can be overcome or significantly minimized by the present invention.

OBJECTS OF THE INVENTION

It is the major object of this invention to provide new and improved methods and apparatus for controlling the advancement angle of a well hole or borehole cut by a rotary drill bit. Another object is to teach a new and improved approach to controlling the advancement angle of a borehole by removing very small amounts of material from a partial arcuate portion of the circumference of a gage corner portion of the borehole during a plurality of revolutions of the drill bit, resulting in a gradual and acceptable angle change.

Another objective is to maintain acceptable and normal rates of drilling penetration while simultaneously controlling the advancement angle of the borehole. Still another object is to obtain positive and reliable control over the change in advancement angle and to accomplish such with relative inexpensive, self-effectuating and reliable methods and apparatus.

Further objects are to utilize certain reliable elements of conventional drill bits and drilling apparatus to control the borehole advancement angle, to selectively control the drilling effect of the drill bit during each revolution in a consistently predictable manner, to simplify the apparatus needed to control and change the advancement angle of the borehole, to minimize the need for special equipment and especially trained personnel to effect changes in the borehole angle, to obtain and apply angle controlling forces and energy without sophisticated sensors, control arrangements and the like, and to further teach a method of controlling the deviation angle of a borehole from vertical to be inherently self-correcting. Other advantages and achievements of the present invention will be apparent to those knowledgeable in the art.

SUMMARY OF THE INVENTION

The present invention involves rotary drill bits having cutting elements which cut a well hole or borehole defined by an axially extending cylindrical sidewall, a drill face extending essentially transversely with respect to the cylindrical sidewall and a gage corner extending circumferentially around the drill face and radially outward at an inclination from the drill face to the sidewall. To control the advancement angle, a different amount of material is removed over a selected partial arc of the circumference of the gage corner, as compared to that amount removed over the remaining partial arc of the circumference of the gage corner. The arcuate portion over which less material has been removed applies a slight lateral force to the drill bit in the radial direction in which it is desired to angle the borehole.

Means associated with the drill bit for removing the different amount of material from the gage corner are selectively activated to achieve the effect over a partial interval of each rotation of the drill bit. One arrangement for actuating the gage corner removal means involves control and energy deriving apparatus attached on the drill string at a predetermined position at which gravity induced sag causes the drill string to contact with the low side portion of the borehole. The energy deriving apparatus derives energy from rotation of the drill string relative to the stationary low side of the borehole sidewall. The energy is derived in pulses of duration related to the partial interval of drill string rotation during which the energy deriving apparatus contacts the sidewall. The energy pulses are applied to control the gage corner removal means. The preselected arc of the circumference of the gage corner over which the different amount of material is removed corresponds or is relates to the interval of rotation during which energy is derived. The angular positional relationship between the gage corner removal means and the energy deriving means is selected to achieve a desired direction of angle advancement relative to the stationary low side portion of the sidewall.

The gage corner removal means include a number of embodiments. A rolling cutter wheel and an abrasion shoe are embodiments of cutting members which are selectively activated to an extended position for contacting and removing an additional amount of material over the selected arc of the gage corner circumference. A hinged connecting apparatus hinges the drill bit with respect to the drill string to place the cutting elements of the drill bit into a more effective cutting position over the selected arc of the gage corner circumference. A single cutter wheel rotating about an axis extending at intersecting angles with respect to radial and axial axes of the drill bit is pivoted to a condition in which the rotational axis of the wheel is angled slightly less with respect to the axial axis of the drill bit, thereby forcing the cutting elements of the single cutting wheel into more effective cutting contact with the gage corner.

The present invention is defined in the appended claims. A more complete understanding of the invention can be obtained from the following description of a preferred embodiment and from the drawings consisting of a number of figures.

BRIEF DESCRPTION OF THE DRAWINGS

FIG. 5 is an axially sectioned view of a borehole extending at an angle from a vertical reference into which a drill string and drill bit have been inserted, and a schematic view of a control and energy deriving means of the present invention.

FIGS. 8 and 9 are schematic illustrations of actuating means associated with the control and energy deriving apparatus of the present invention. Specifically, FIG. 8 illustrates a piston and cylinder activation means, and FIG. 9 illustrates an electrical solenoid activation means.

FIG. 15 is an axially extending section view of a drill bit including a pivotable single rolling cutter wheel. The drill bit is shown connected to a drill string illustrated in phantom and inserted in an axially sectioned borehole.

FIG. 16 is a reduced transvserse section view of the drill bit taken substantially in the plane of line 16—16 of FIG. 15.

DETAILED DESCRIPTION OF PREFERRED EMBODIMENTS

By way of general introduction, control over the advancement angle of a borehole as it is cut or advanced through earth material or the like is achieved by effects created in a particular type of well hole or borehole. The characteristics of the borehole, as well as a discussion of one well known rotary drill bit having cutting elements arranged for cutting a borehole having these characteristics, is discussed in a first section below. To control the advancement angle, a different amount of earth material is removed over a partial selected arcuate portion of the circumference of a gage corner portion of the borehole, as compared to the amount of material removed over the remaining arcuate portion of the circumference of the gage corner. As a result of selective material removal, lateral forces induced by portions of the borehole force the drill bit to angle in a desired manner. A discussion of the general concepts and method of removing material from the gage corner and the advancement angle control effects created are discussed in the second section below. To achieve substantial angle control effects, it is necessary to remove the different amount of material over the selected arcuate portion of the circumference of the gage corner during each revolution of a number of sequential revolutions of the drill bit. The selected arc should be approximately consistent in angular duration and angular position relative to the borehole from one revolution to the next. A control and energy deriving arrangement for achieving these effects is discussed in the third section below. Lastly, various embodiments of means associated with the drill bit and the drilling apparatus for removing the gage corner material are discussed separately in a number of individually designated sections appearing at the end of this detailed description.

ROTARY DRILL BIT AND BOREHOLE CHARACTERISTICS

Figure 1:
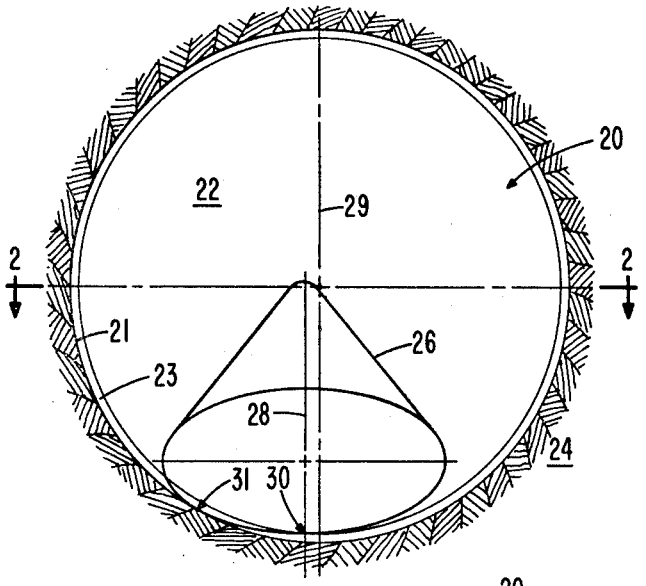
FIG. 1 is a top view looking axially into a borehole of the type to which the present invention relates and which is formed by a schematically illustrated cone cutter assembly.
Figure 2:
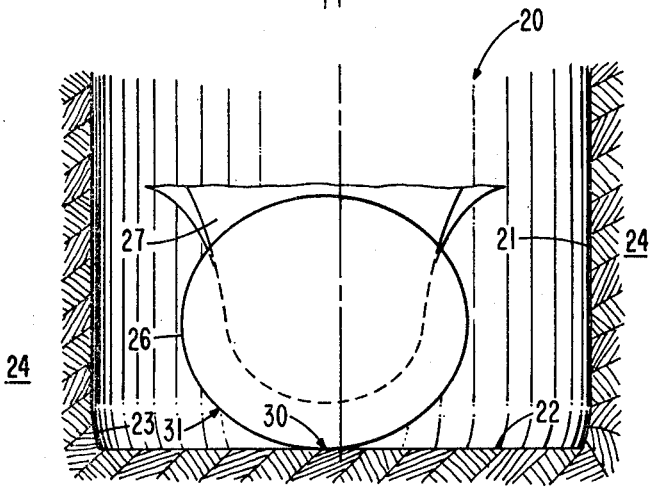
FIG. 2 is an axially extending section view taken substantially in the plane of line 2—2 of FIG. 1 and schematically illustrating the maximum circumference of the radial outermost cutting wheel element of the cone cutter assembly.

The characteristics of the borehole to which the present invention relates, and one type of rotary drill bit which effectively cuts a borehole having these characteristics, are known in the art. Referring to FIGS. 1 and 2, a borehole 20 is shown to include a cylindrical sidewall portion 21 which extends generally coaxially with the axis of the borehole, a drill face portion 22 extending essentially transversely with respect to the cylindrical sidewall portion 21, and a gage corner portion 23 which extends circumferentially around the outer periphery of the drill face 22 and radially outward at an inclination to the sidewall 21. Of course, the sidewall and drill face and gage corner portions are defined by the surrounding earth material 24 as the borehole 20 is cut. It is to rotary drill bits which cut a gage corner portion 23 of the borehole that this invention relates, in certain aspects.

One commonly used and very effective type of rotary drill bit which cuts a borehole having the sidewall 21 and drill face 22 and gage corner 23, is the well-known offset three-cone bit, one example of which is disclosed more fully in U.S. Pat. No. 2,148,372 to Garfield. An offset three-cone bit utilizes three groups of rolling cutting wheels and cutting elements, and each group or cutting assembly is formed in a general overall shape of a cone. Each of the cone-shaped cutting assemblies is offset, meaning that the rotational axis of each assembly extends at a slight intersecting angle or in spaced parallel relation with respect to a radial reference from the axial and rotational center of the drill bit. In both cases, the cone assembly axis does not pass through the bit axis. It is this offset geometry which causes the cone cutter assemblies to cut or leave the gage corner 23 as the borehole is cut. One offset cone cutter assembly 26 is schematically illustrated in FIGS. 1 and 2. A bit support structure 27 positions the cone cutter assembly 26 with its axis 28 of rotation offset in spaced parallel relation to a radial reference 29 extending from the axial and rotational center of the bit support structure 27. A description of the intersecting-angle geometry of an offset cone cutter assembly is present in the above identified Garfield patent. Both types of offset geometry are well known in the art.

The effect of the offset geometry is to create the gage corner portion 23, as can be generally understood from FIGS. 1 and 2. Due to the offset of each cone cutter assembly 26, the point 30, which is axially or vertically below the axis 28 of rotation of the cone cutter assembly 26, is spaced a slight radial distance inward with respect to the cylindrical sidewall 21. Another point 31 circumferentially displaced from the point 30 is the point at which the rotating cone cutter assembly 26 cuts the maximum diameter or gage of the borehole 20, and thus, also defines the cylindrical sidewall 21. As seen in FIG. 2, the point 31 is axially displaced from the drill face 22 and from the point 30. Because point 30 is located radially inward with respect to point 31 due to the geometry of the offset cone cutter assembly 26, a sloping or inclined gage corner 23 is formed between the point 31 at maximum diameter of the cylindrical sidewall and the point 30 at the maximum diameter of the drill face. The material between points 30 and 31 is typically curved, and it is this material which defines the gage corner 23. The cutting elements radially inwardly spaced from the point 30 on the cone cutter assembly 26 remove particles of material 24 to define the drill face 22.

The advantages of an offset three-cone rotary drill bit are well known. The offset geometry of the cone cutter assemblies achieves a combination of rolling and scraping action on the earth material defining the drill face and gage corner. The rolling and scraping action removes particles of material much more effectively and more quickly then if the offset geometry was not utilized. Due to the proven advantages of the offset three-cone bit, it is expected that such a bit will be utilized in either a substantially original or slightly modified form in practicing the present invention. It should be understood, however, that other types of rotary drill bits which cut a circumferential gage corner extending at an inclination outward from the drill face to the sidewall are within the scope of the present invention.

The substantial advantage to utilizing the offset three-cone bit or a similar bit in practicing the invention is that no reduced effectiveness or loss of penetration rate occurs as the borehole is cut and simultaneously angled in the desired manner. Many prior art approaches of controlling the advancement angle of the borehole removal of the conventional drill bit and insertion into the borehole of special cutting devices and the like. Other prior art approaches involve stopping the rotation of the drill bit and attached drill string while an auxiliary cutting effect takes place. In most prior art approaches, alterations in structure of the bit or in the way which the bit is operated in terms of revolutions per minute, weight on the bit or hydraulic cuttings removal are required, and these alterations adversely affect performance and the drilling penetration rate. Maintaining a good drilling rate is particularly important because of the economics involved in drilling and in angling or correcting the direction of a borehole. The extra drill rig time consumed, the cost of extra or special tools, and the cost of extra and specialized skilled personnel can amount to a considerable expense with the currently used approaches to angle control.

ANGLE CONTROL

Figure 3:
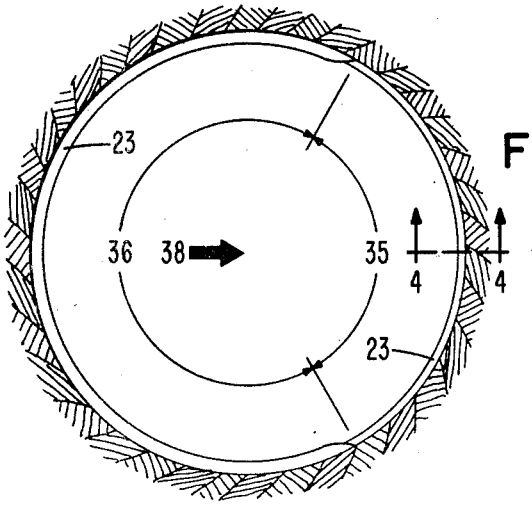
FIG. 3 is a top view similar to FIG. 1 illustrating a selected partial arcuate portion of the circumference of the gage corner and a remaining arcuate portion of the circumferential gage corner.
Figure 4:
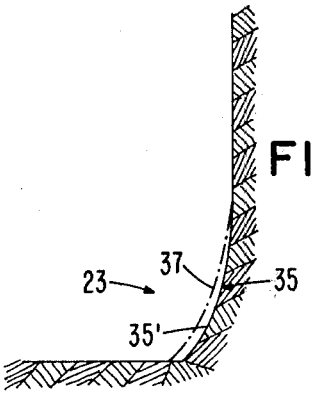
FIG. 4 is an enlarged fragmentary section view illustrating removal of a different amount of the gage corner of the borehole, taken in an axially extending section plane of line 4—4 of FIG. 3.

To control the angle of advancement of the borehole cut by the rotary drill bit, a different amount of material is removed over a partial preselected arc of the circumference of the gage corner than the amount of material removed over the remaining partial arc of the circumference of the gage corner. FIGS. 3 and 4 schematically illustrates this angular control concept. The partial preselected arc is referenced 35 in FIG. 3, and the remaining arc of the circumference of the gage corner 23 is referenced 36. FIG. 4 illustrates in exaggerated condition an additional amount of material removed from the preselected arc 35. The dotted lines 37 indicate, for comparison purposes, a normal amount of material which would normally define the gage corner resulting from normal operation of the drill bit. By removing additional material to a level indicated by the solid line 35', the size and radial inclination of the gage corner 23 is slightly reduced over the arc 35. However, the size and inclination of the gage corner material in the remaining arc 36 is that normally cut by the rotary drill bit, represented at 37. Consequently, the remaining arc 36 of the gage corner extends radially inward at the full or normal inclination.

The remaining partial arc 36, being of full normal size and inward inclination, applies a slight radially inward directed or lateral force on the drill bit in the general radial direction of the selected arc 35. The slight lateral force is illustrated by a vector referenced 38. In time after a sufficient number of drill bit revolutions, the lateral force applied with each revolution effectively forces the drill bit in the direction of the vector 38. The drill bit begins to advance laterally in the direction of vector 38, and the advancement angle of the borehole is changed.

The manner in which one arcuate portion of the inclined gage corner 23 applies lateral force on the drill bit to control the advancement angle is somewhat similar in overall effect to a whipstock effect known in the art to occur when a conventional drill bit encounters a sloping geological formation of different hardness. The whipstock effect simply describes a naturally-occurring physical result, in contrast to the present invention, which selectively and positively creates angle control effects on the drill bit. One description of the whipstock effect and a further description of the offset three-cone drill are found in an article appearing in *Drilling,* May 1965, Page 34.

The amount of material removed with each revolution over the preselected arc need not be large to control the advancement angle. In fact, very small amounts will achieve acceptable angular control. Removal of a very small amount over the preselected arc during each of a plurality of subsequent revolutions creates anistropic action sufficient to achieve significant angular deviation. As an example, it is possible to change the angle of the borehole advancement by approximately 1° by forcing the drill bit laterally by an amount of two to three thousandths of an inch during the course of drilling 100 feet. It is apparent, therefore, that by operating the drill bit and creating different gage corner removal effects over a sufficient time period, sizeable angle deviation build-up will occur and effective control over the advancement angle of the borehole results. Such lateral drilling rates are not difficult to obtain and can be achieved without sacrificing the normal adequate performance of the rotary drill bit.

It should also be noted that in addition to removing an additional amount of material over that which would normally be removed, as is the situation illustrated in FIG. 4, a related concept involves inhibiting the removal of a normal amount of gage corner material over the remaining partial arc while allowing normal removal of the material over the remaining partial arc. Of course, the overall effect of either removing additional material or inhibiting normal removal of material is the same: a lateral force is applied to the drill bit by the arcuate portion of the gage corner circumference over which the greater amount of material remains, and the drill bit is angled appropriately. Means for inhibiting the removal of a normal amount of gage corner material over one partial arc while allowing general removal over the remaining partial arc is disclosed and claimed in the aforementioned U.S. Pat. No. 4,211,292, of which this is a division.

To achieve suitable angle control, the different amount of material must be removed over the preselected arc during each of a number of sequential revolutions. Furthermore, the angular positions of the beginning and ending points of the preselected arc must be approximately the same during each revolution of the drill bit so that the lateral force 38 is applied approximately in the same lateral direction to the drill bit during each revolution. One advantageous arrangement for achieving this effect is next described.

CONTROL AND ENERGY DERIVING ARRANGEMENT

To remove the different amount of material over the preselected arc, gage corner removal means are associated with the rotary drill bit. The gage corner removal means are activated during a selected partial interval of one or each rotation of the drill bit, to remove the different amount of material from the gage corner over the selected arc. It is therefore important to activate and deactivate the gage corner removal means at approximately the same rotational positions during each drill bit rotation. The interval of rotation during which the gage corner removal means is activated corresponds in angular duration to the selected arc of the circumference of the gage corner over which the different amount of material is removed.

One control arrangement for activating the gage corner removal means is to provide a control means at the surface of the earth which is operatively connected for activating the gage corner removal means over the preselected arc. Such control means employs sensors or the like for determining the rotational position of the drill bit as it is continually rotated, and selectively supplies energy to the gage corner removal means during the selected and predetermined interval of drill bit rotation.

A more appropriate control means for activating the gage corner removal apparatus by deriving energy from rotation of the drill string relative to the borehole sidewall is illustrated in FIGS. 5 to 9. The borehole 20 shown in FIG. 5 extends axially downward at an angle with respect to a vertical reference. A rotary drill bit 40 is attached to the end of a drill string 41 and inserted into the borehole. The drill string 41 comprises a plurality of conventional drill collars 48 connected together in a manner known in the art. The drill bit 40 is attached to the end of the drill string and placed in contact with the drill face 22 of the borehole. The drill string 41 extends through the borehole 20 to the surface of the earth where conventional drilling apparatus 44 is connected to the drill string for rotating the drill string and the drill bit connected at the end of the drill string. Of course, rotating the drill bit at the drill face cuts and removes particles of the material 24 to advance the borehole.

Because the drill string 41 extends at an angle with respect to a vertical reference, gravity bends or induces the drill string toward the low side portion of the cylindrical sidewall of the borehole. The gravity induced sag in the drill string causes it to contact the low side portion of the sidewall at a point 42 axially spaced from the drill face and drill bit. Means, generally referenced 43, are fixed to the drill string at point 42 for the purpose of deriving energy from rotational movement of the drill string relative to the stationary cylindrical sidewall over a selected partial interval of each rotation of the drill string during which the means 43 contacts the low side portion of the sidewall. Of course, the distance between the drill bit and the point 42 will vary depending upon a number of factors including the angle of the borehole 40 with respect to a vertical reference and the stiffness of the drill collars comprising the drill string.

Figures 6, 7:
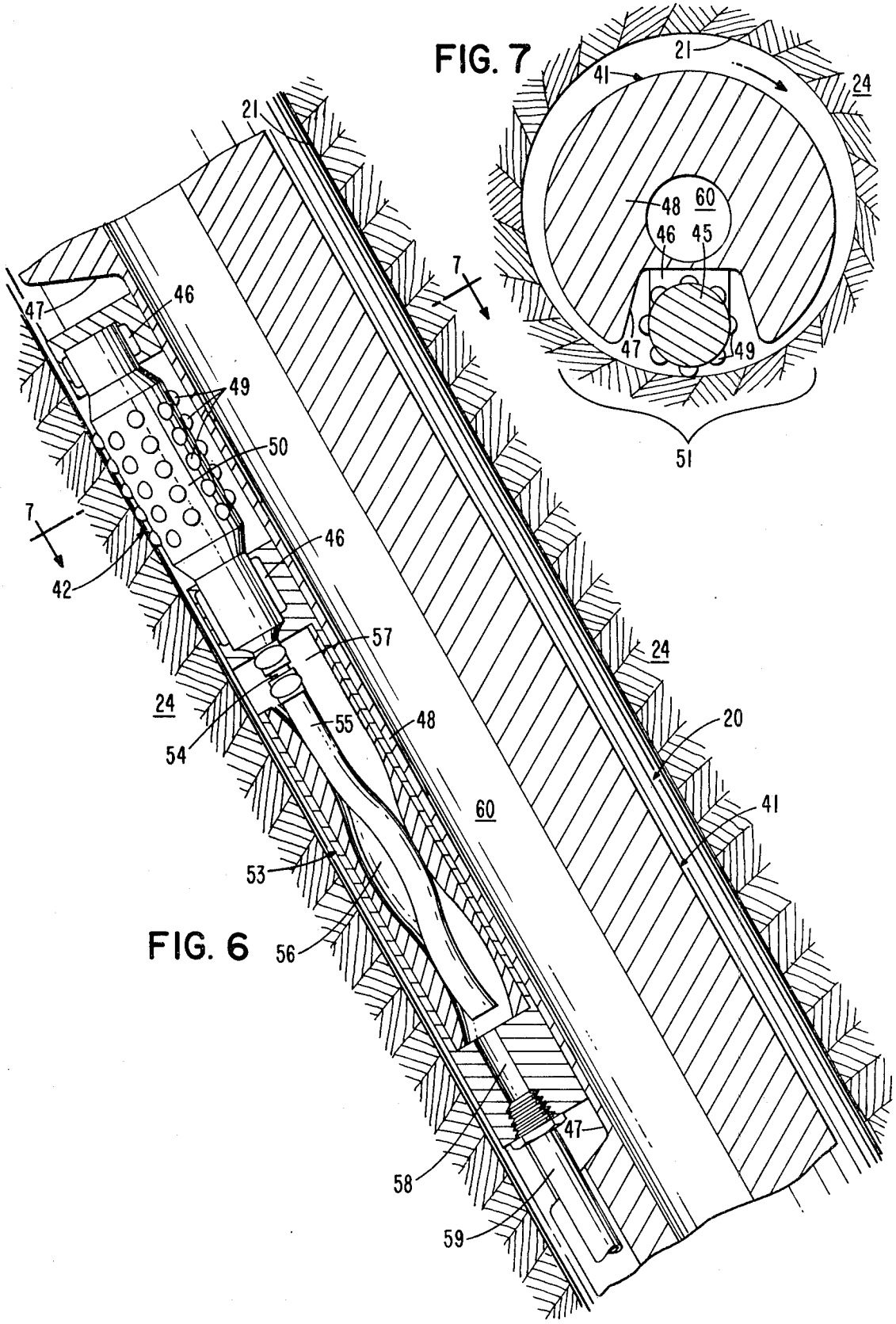
FIG. 6 is an axially extending section view taken substantially in the plane of line 6—6 of FIG. 5, in which the drill string and control and energy deriving apparatus have been rotated 180°.
FIG. 7 is a transverse section view taken substantially in the plane of line 7—7 of FIG. 6.

One example of means 43 for deriving energy is illustrated in FIGS. 6 and 7. A roller member 45 or other driver means is fixed in an exposed condition to the exterior surface of the drill string 41. Conventional bearing connection means 46 attach the roller member 45 to the drill string, and the bearings 46 allow the roller member to rotate relative to the drill string. The roller member 45 and bearings 46 are received within a milled pocket 47 formed in the exterior surface of a drill collar 48 comprising a portion of the drill string 41. Teeth 49 or other frictional engagement members extend from an outer cylindrical surface 50 of the roller member 45. The teeth 49 of the roller member are exposed at the outer periphery of the drill string and are thus free to contact and roll against the low side portion of the sidewall 21 at the point 42. The teeth 49 are made of conventional wear-resistant material. A conventional drilling fluid passage 60 extends axially through the drill collar 48 and the drill string 41.

As the drill string 41 rotates, the roller member 45 is periodically rotated into contact with the low side portion 51 of the cylindrical sidewall 21, as is shown in FIG. 7. During contact with the low side portion 51, the teeth 49 contact the sidewall 21, and the rotation of the drill string relative to the stationary sidewall causes the roller member 45 to rotate about its bearing connection means 46. With further drill string rotation, the roller member 45 moves to a position at which the teeth 49 no longer contact the cylindrical sidewall. Thus, roller member 45 contacts and rolls against the low side portion 51 of the cylindrical sidewall during a predetermined partial interval of drill string rotation, and, during the remaining partial interval of the drill string rotation, the roller member 45 avoids contact with the sidewall 21. This periodic contact results because the axial center of the drill string does not coincide with the axial center of the borehole 20 due to the sag induced by gravity.

Thus, the roller member is rotated during a selected partial interval of the drill string rotation and is not rotated during the remaining partial interval of drill string rotation. Rotation occurs at the same rotational position of the drill string during each revolution, since the roller member is at a fixed position and the low side portion 51 presents a stationary surface upon which the roller member periodically contacts and rolls against.

Rotational movement of the roller member 45 is applied to an energy generator means to generate energy. As shown in FIG. 6, a hydraulic pump 53 such as a conventional progressive cavity pump is operatively connected by connection means 54 to be rotated by the roller member. The connection means 54 transmits rotation from the roller member 45 to the pump 53 and rotates a screw-like rotor member 55 within a helical shaped stator 56. An intake opening 57 at one end of the stator 56 receives fluid screened free of coarse particle cuttings and utilized by the pump 53. The fluid is forced through a series of progressive cavities formed by interaction of the rotating rotor member 55 and stationary stator 56, and the fluid is pressurized and delivered from an outlet opening 58 of the pump 53. A conduit 59 connected at the outlet 58 of the pump conducts the pressurized fluid for use by the gage corner removal means associated with the drill bit. The conduit 59 extends along the exterior of the drill string 41 preferably within a milled channel, not shown, or extends within the interior of the drill string. The supply of hydraulic fluid for the pump 53 is obtained from the outflow of fluid and particle cuttings flowing out of the borehole between the drill string and the cylindrical sidewall or from drilling fluid in the passage 60, by screening it free of coarse particle cuttings or from other sources as will be described. The outflow of fluid and particle cuttings between the drill string and the sidewall is established by directing a flow of drilling fluid through the passage 60 in the drill string and directing the drilling fluid from wash jets of the drill bit onto the drill face. The particles cut and removed by the drill bit are thus washed away from the drill and face and out of the borehole, as is conventional in the art.

It is apparent from the foregoing description of the energy deriving means 43 that the pump 53 supplies energy only when rotated by the roller member 45. The roller member 45 is rotated only during the partial interval of each rotation of the drill string when the roller member contacts and rolls against the low side portion of the cylindrical sidewall. Therefore, the energy is supplied in the form of pulses delivered during the time interval that the roller member contacts and rolls against the cylindrical sidewall.

The energy pulses are utilized for operatively controlling the removal of the different amount of material over the selected partial arc of the circumference of the gage corner. The energy pulses activate the gage corner removal means associated with the drill bit. One example of activation means utilizing the hydraulic pressure pulses is a piston and cylinder arrangement 66 schematically illustrated in FIG. 8. The pulses of pressurized hydraulic fluid are supplied to the piston and cylinder arrangement 66 and force the piston to move. Another example of activation means is illustrated in FIG. 9. The roller member 45 is operatively connected to operate an electrical generator 67. Electrical energy derived from the operating generator 67 is supplied over conductors 68 to a solenoid arrangement 69. The solenoid includes a conventional coil 70 for producing electromagnetic flux which acts on and moves a magnetic armature 71. Both the piston shown in the FIG. 8 arrangement and the armature shown in the FIG. 9 arrangement include biasing means to return these moveable elements to the original position after the pulse of energy terminates.

In the described manner, energy is derived from rotation of the drill string relative to the cylindrical sidewall by energy deriving means 43. The energy derived is applied to activation means, such as the piston and cylinder arrangement 66 or the solenoid arrangement 69. In other cases the energy derived may be directly applied to the gage corner, in which circumstance the energy deriving means also functions as activation means.

The activation means is operatively associated with the gage corner removal means. Upon activation, the gage corner removal means selectively removes the different amount of material over the preselected partial arc of the circumference of the gage corner. The gage corner removal means is preferably activated only so long as the pulse of energy is applied. The pulse of energy is applied during the interval of drill string rotation time that the roller member 45 contacts the low side portion 51 of the sidewall. The interval of drill string rotation corresponds or bears a predetermined relationship to the angular duration of the preselected arc. By adjusting the predetermined angular positions of the gage corner removal means and the energy deriving means a physical relationship is established between the stationary low side portion 51 of the borehole and the direction in which it is desired to angle the borehole. As explained, the direction in which the borehole will be angled is determined by the angular position over which a different amount of material is removed from the preselected arc. The predetermined arc can be located in any angular position relative to the low side of the borehole sidewall to advance the borehole at a desired angle. By selecting the proper angular relationship of the roller member 45 and the gage corner removal means, an arrangement for automatically correcting any significant deviation of the borehole from vertical is obtained.

Although one roller member 45 has been illustrated connected to the drill string, it may prove advantageous to employ three equally circimferentially spaced rollers about the outer exterior surface of the drill string. Three equally spaced rollers would reduce lateral force impulses supplied to the drill string as each roller rotates into contact with the low side portion of the sidewall.

The three equally spaced rollers have a smoothing effect since one of the rollers would probably be in contact with the low side portion at all times. All three rollers could be connected to separate hydraulic pumps or electrical generators. The output energy of each electrical generator or pump could be appropriately controlled or delivered for use in controlling a drilling operation of the nature described. Energy deriving means can be employed at a number of different axial distances from the drill bit. An appropriate control arrangement controls the gage corner removal means by energy derived from selected ones of the energy deriving means.

ROLLING CUTTING WHEEL

Figure 10:
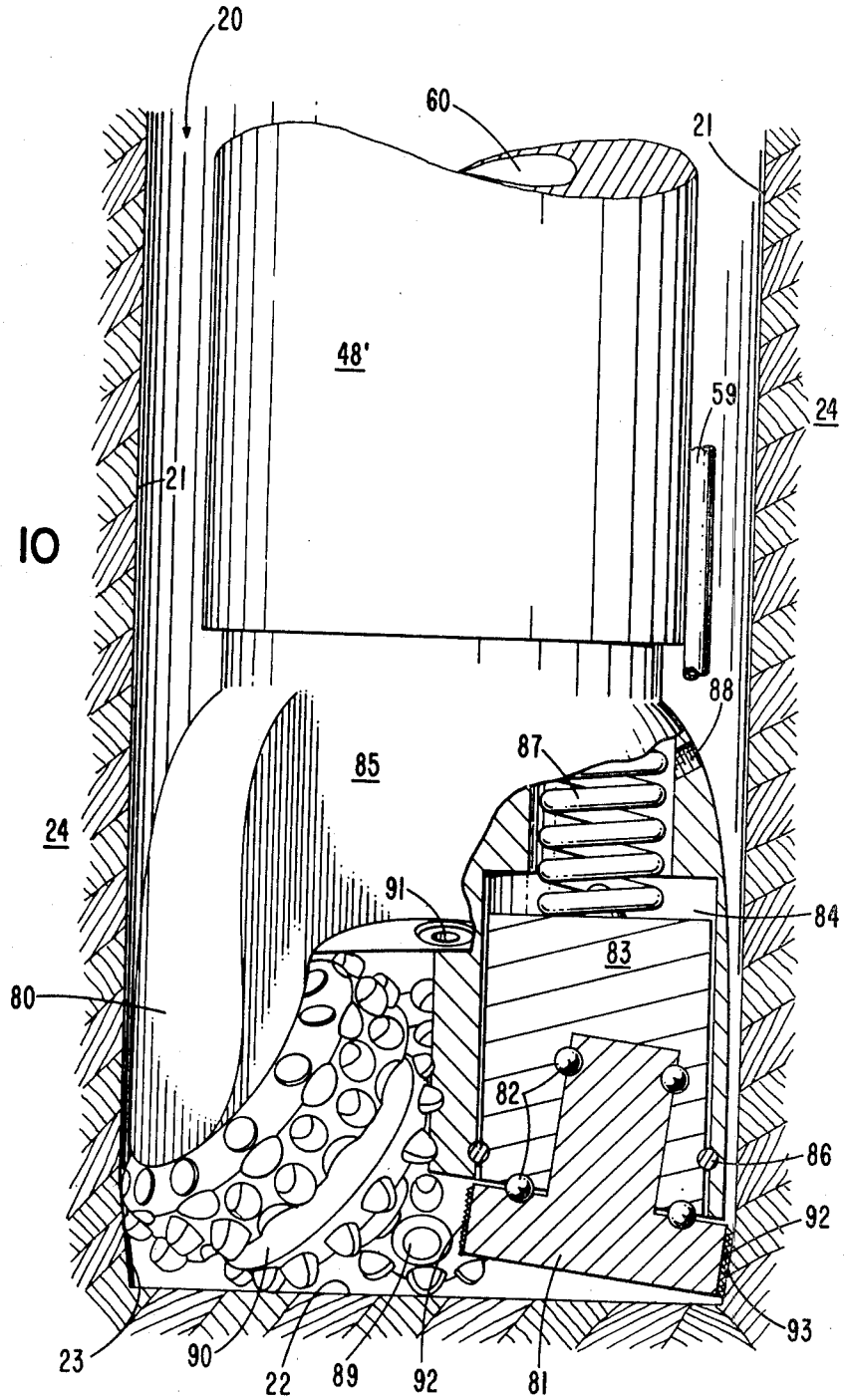
FIG. 10 is a side elevational view of a drill bit with a portion away in partial section to illustrate a selectively extendable rolling cutter wheel. The drill bit is shown attached to a drill collar and positioned in an axially sectioned borehole.

A drill bit 80 shown in FIG. 10 includes gage corner removal means in the form of a cutter member which is selectively extendable to substantially contact and cut or remove an increased amount of material from the gage corner 23 over the partial selected arc. The cutter member is in the form of a rolling cutter wheel 81 attached by a plurality of conventional ball bearings 82 to a sliding piston member 83. The sliding piston member 83 is received within an axially extending piston chamber 84 formed in a support structure 85 for the drill bit and its elements. A fluid tight connection is provided by a seal 86 intermediate the sliding piston member 83 and the piston chamber 84. A tension spring 87 extends from the sliding piston member 83 to the bit support structure 85 and biases the piston member toward a retracted (upward) position. The conduit 59, which extends from the hydraulic pump 53 of the energy deriving means 43, is connected by a conventional fitting, not shown, into an inlet opening 88 to the piston chamber 84. Upon delivery of the pressurized fluid pulses through the conduit 59 into the piston chamber 84, the pressurized pulses force the piston to a projected (downward) position. The rolling cutter wheel 81 attached to the sliding piston member 83 is correspondingly forced in an axially downward position into substantial cutting contact with the gage corner material. At the termination of the pressure pulse, the tension spring 87 returns the piston member 83 and attached rolling cutter wheel 81 to the retracted position. The tension of spring 87 is selected to obtain optimum response to the pressure pulses which are applied at a frequency related to the rotational frequency or rate of the drill string. The piston member is thus one form of extendable means which moves to projected and retracted positions. The piston member 83 and chamber 84 form one example of activation means.

Two conventional offset cone cutter assemblies 89 and 90 are employed on the drill bit 80. The two cone cutter assemblies 89 and 90 form the borehole 20 having the cylindrical sidewall 21, the drill face 22 and the gage corner 23 independently of the rolling cutter wheel 81. The cutting wheel 81 and piston 83 are positioned on the drill bit structure 85 in the position which would otherwise be occupied by a third cone cutter assembly of a conventional offset three-cone bit. The drill bit structure 85 is extended in this area to define the piston chamber 84 and to position the piston member appropriately. Arranged in this manner, the rolling cutter wheel 81 and the cone cutter assemblies 89 and 90 are spaced at one-third circumferential or rotational intervals with respect to one another. The drill bit structure 85 includes a conventional threaded upper end connection, not shown, which serves as means for attaching the drill bit 80 to the drill string at the endmost drill collar 48'. The bit structure also includes conventional wash jet nozzles 91 through which drilling fluid is emitted to wash particle cuttings away from the drill face and gage corner. The particle cuttings and fluid are conducted between the drill string and the cylindrical sidewall out of the borehole.

Rotary drill bits employing only two cone cutter assemblies have proven successful in drilling certain geological formations. By employing the two cone cutter assemblies 89 and 90, the drill bit 80 maintains acceptable drilling rate effectiveness.

The rolling cutter wheel 81 rotates in a plane essentially transverse with respect to the rotational axis of the drill bit. The axis of rotation of the rolling cutter wheel is angled slightly with respect to the rotational axis of the drill bit. The cutting wheel 81 includes an outer circumferential cutting surface 92 formed by conventional cutting elements. The radial outermost point 93 of the circumferential surface 92 is in axial alignment with the gage corner 23 and generally contacts and rides upon the inclined gage corner 23 during drill bit rotation. Upon application of the energy pulse form of the pressurized fluid, the projected piston member 83 forces the cutting surface 92 of the cutting wheel 81 into substantial cutting contact with the gage corner 23. The substantial cutting contact removes additional material from the gage corner as compared to that material removed by normal operation of the conventional cone cutter assemblies 89 and 90. The additional amount of material is removed from the gage corner 23 over the preselected arc of the circumference of the gage corner, and the selected arc corresponds in angular duration to the interval of rotation of the drill string during which the pressure pulse is applied to the piston member 83. After termination of the pressure pulse, the tension spring 87 returns the piston member and cutting wheel 81 to a retracted position out of substantial cutting contact with the gage corner material 23. In the retracted position, no substantial additional material is removed from the gage corner. Thus, the remaining partial arc of the gage corner circumference, being of slightly greater size, applies a slight lateral force to the drill bit. As a result, selective control of the advancement angle of the borehole is achieved.

ABRASION SHOE

Figure 11:
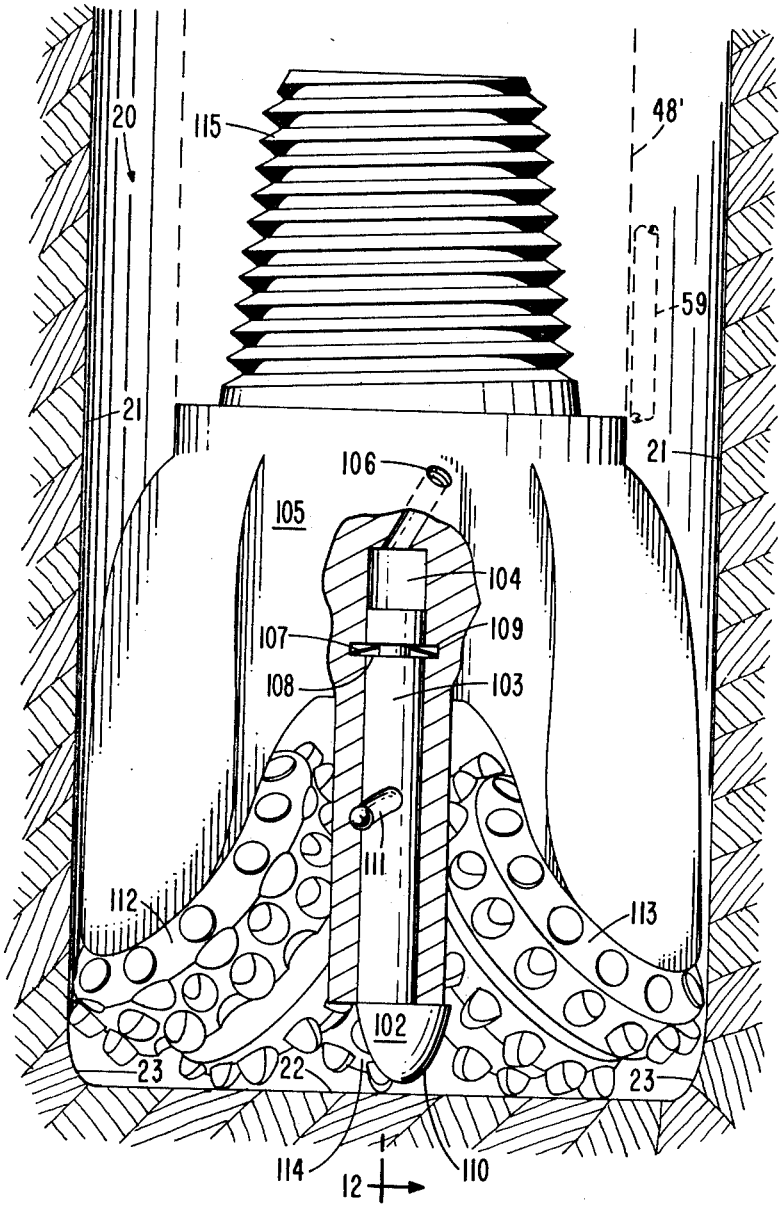
FIG. 11 is a side elevational view of a drill bit with a portion broken away in partial section to illustrate a selectively extandable abrasion shoe member. The drill bit is shown attached to a drill collar illustrated in phantom, and is positioned in an axially sectioned borehole.
Figure 12:
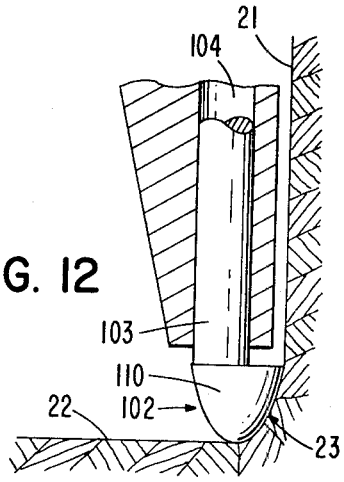
FIG. 12 is a partial sectional view of a portion of FIG. 11 taken in the view plane of line 12 and illustrating an eccentric contour surface of the abrasion shoe member.

A rotary drill bit 100 shown in FIGS. 11 and 12 includes gage corner removal means in the form of a cutter member which is selectively extendable to substantially contact and cut or remove an increased amount of material from the gage corner 23 over the partial selected arc. The cutter member is in the form of an abrasion shoe member 102 attached to or formed as an integral part of a sliding piston member 103 located within a piston receiving chamber 104. The piston receiving chamber 104 is formed in a bit support structure 105 at a predetermined location to position the abrasion shoe member 102 to contact the gage corner 23. Seals, not shown, provide a fluid-tight seal between the piston member 103 and the piston chamber 104. A fluid inlet 106 communicates with the piston chamber 104, and a conventional fitting, not shown, connects the conduit 59 from the hydraulic pump 53 to the inlet 106. A Bellville spring 107 extends between notches 108 and 109 formed respectively in the piston member 103 in the chamber 104. The piston member 103 may be formed in pieces to facilitate assembly. The Bellville spring biases the piston member 103 toward a retracted (upward) position within the chamber 104. Upon application of energy in the form of a pressurized fluid pulse through conduit 59, the pressure within the chamber 104 forces the piston 103 and the attached abrasion shoe 102 to an axially extended (downward) position into substantial cutting contact with the gage corner. The piston member 103 is one form of extendable means for moving to projected and retracted positions and the piston member and chamber 104 form one example of activation means.

The abrasion shoe member 102 includes an abrasion or cutting surface 110 formed at a position adapted to contact the gage corner 23. The abrasion surface 110 is shaped as an offset conical surface as shown best in FIG. 12. The axis of the conical cutting surface 110 is eccentrically spaced in relation to the center axis through piston member 103. A helical ball groove arrangement 111 is connected between the piston chamber 104 and the sliding piston member 103. The ball groove arrangement 111 causes the piston member to rotate slightly upon movement to the projected position. When projected and rotated slightly, the eccentrically shaped abrasion surface 110 is forced into substantial cutting and abrading contact with the gage corner 23. Since the piston receiving chamber 104 must be formed slightly inwardly spaced from the outer circumference or periphery of the drill bit, the eccentrically shaped abrasion surface 110 and the ball groove arrangement 111 bring the cutting surface 110 into cutting alignment with the gage corner.

Three conventional offset cone cutter assemblies 112–114 are positioned on the bit support structure 105. The cutting elements of the cone cutter assemblies 112–114 are arranged to cut the borehole 20 defined by the cylindrical sidewall 21, the drill face 22 and the gage corner 23. A threaded connection 115 is provided on one end of the bit support structure to connect the drill bit 100 to the end of the drill string at the endmost drill collar 48'.

Selective projection of the abrasion shoe member 102 brings the abrasion surface 110 into substantial abrading contact with the gage corner and removes additional amount of material from the gage corner as compared to that amount removed by the cone cutter assemblies 112–114. The application and duration of the pressure pulse from conduit 59 causes the abrasion shoe member 102 to maintain firm cutting contact with the gage corner over the selected arc of the circumference of the gage corner. At the termination of the pressure pulse, the abrasion shoe member is moved to the retracted position, and the abrasion surface 110 does not contact the remaining arc of the gage corner circumference. The interval of drill string and drill bit rotation during which the additional amount of material is removed from the gage corner 23 over the selected arc corresponds in angular duration to the angular duration of the rotational interval during which the pressure pulse is supplied. It is in this manner that the abrasion shoe member 102 removes a different amount of material over the selected arcuate portion of the circumference of the gage corner. The remaining partial arc of the gage corner circumference, not contacted by the abrasion surface and thus of slightly larger size, applies a slight lateral force to the drill bit. As a result, selective control of the advancement angle of the borehole is achieved.

HINGED DRILL BIT CONNECTOR

Figure 13:
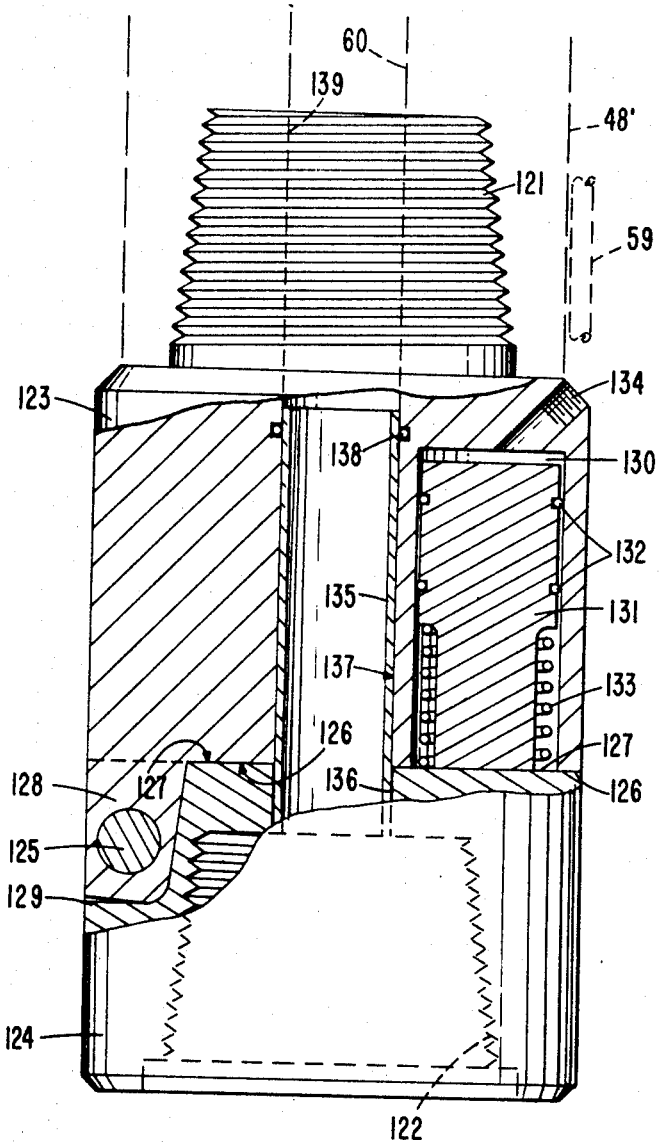
FIG. 13 illustrates a hinged connector apparatus with a portion broken out in an axially extending section to illustrate elements within the apparatus. A drill collar is shown partially and in phantom connected to the connector apparatus.
Figure 14:
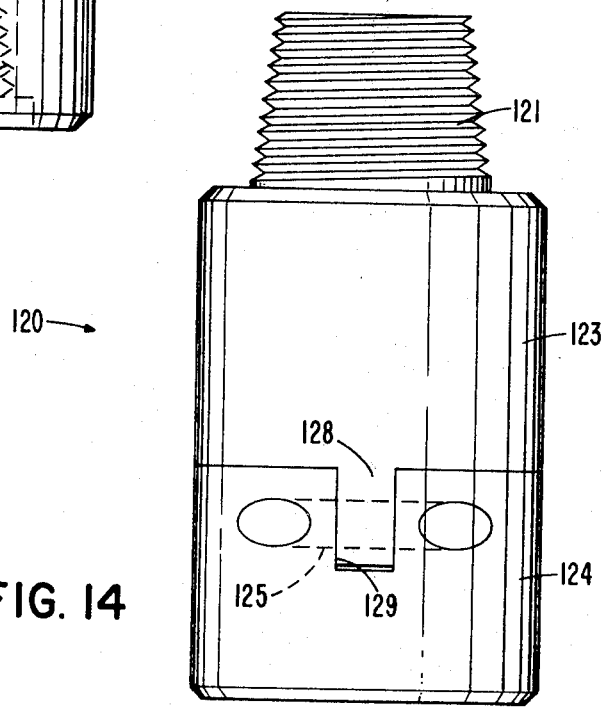
FIG. 14 is a reduced view of the hinged connector apparatus of FIG. 13 rotated 90° counterclockwise with respect to the view of FIG. 13.

A hinged connector apparatus 120 shown in FIGS. 13 and 14, is one form of gage corner removal means arranged for controlling a drill bit to remove a different amount of material over a selected partial arc of the circumference of the gage corner. The connector 120 includes a threaded connection 121 to connect to the end of the drill string at the endmost drill collar 48'. A threaded receptacle 122 is provided for attaching a drill bit, not shown, having cutting elements arranged for cutting the cylindrical sidewall, the drill face, and the gage corner. Typically, it is expected that a conventional offset three-cone drill bit will be utilized in conjunction with the conductor 120.

The hinged connector apparatus 120 comprises an upper body segment 123 which is connected to the end of the drill string at the threaded end 121. The hinged connector 120 also includes a lower body segment 124 which is adapted to be connected to the drill bit at the threaded receptacle 122. A hinge pin 125 hingeably connects the lower body segment 124 to the upper body segment. The hinge pin 125 is positioned at a point radially adjacent the outer periphery of the body segments and radially displaced from the rotational axis of the body segments. The upper body segment includes a transversely extending lower flat surface portion 126 which contacts a corresponding transversely extending upper flat surface portion 127 formed on the lower body segment. With the flat surfaces 126 and 127 in contact, the lower body segment is in axial alignment with the upper body segment, and the center axis of the threaded receptacle 122 is colinear with the axis of the threaded end 121. A downward projecting tab member 128 extends from the flat surface 126 of the upper body segment and is received within a correspondingly shaped receptacle 129 formed into the flat surface 127 of the lower body segment. The hinge pin 125 extends through the projecting tab 128 and the lower body segment 124, as is shown in FIG. 14 to form hinge connection means. Because the projection member 128 fits very closely within the receptacle 129 the projecting tab 128 and receptacle 129 also form means for operatively connecting the upper and lower body segments to resist relative rotation with respect to one another.

At a position preferably diametrically opposite the hinge pin 125, a piston receiving chamber 130 is formed in the upper body segment. The chamber 130 preferably extends in axial direction from the flat surface 126 in an aligned and parallel manner with the center axis of the hinged connector apparatus 120. Received within the chamber 130 is a sliding piston member 131. A fluid tight seal is provided between the chamber 130 and the piston 131 by seal members 132. A compression spring 133 extends between the piston member and the flat surface 127 of the lower body segment 124. The spring 133 biases the piston member to a retracted (upward) position allowing the surfaces 126 and 127 to contact one another. An inlet opening 134 communicates with the piston chamber 130. A conventional connector, not shown, connects the conduit 59 to the inlet opening 134.

Upon application of a fluid pressure pulse, the piston member 131 extends to its projected position and causes the lower body segment to pivot about the hinge pin 125. A resilient sealing element, not shown, extends between the surfaces 126 and 127 of the body segments 123 and 124, to prevent the entry of particle cuttings between the surfaces which could prevent the lower body segment 124 from returning fully to a non-pivoted position. The piston member is one example of extendable means for selectively pivoting the lower body segment with respect to the upper body segment. The piston 131 and chamber 130 are one form of activation means for activating the piston or extendable means to the projected position. The amount of compression force of spring 133 is selected to obtain optimum response to the pressure pulses which are applied at a frequency related to the rotational frequency or rate of the drill string.

An axially centered drilling fluid conduit 135 extends between the upper and lower body segments. An opening 136 formed in the lower body segment positions the conduit 135 in alignment with the conventional drilling fluid passage 60 formed in the drill bit. The drilling fluid conduit is brazed or otherwise suitably connected in a fluid-tight manner within the opening 136. An opening 137 in the upper body segment extends axially upward from the flat surface 126 and receives the drilling fluid conduit 135 therein. A seal 138 attaches the conduit 135 in a moveable fluid-tight manner within the opening 137. Since the lower segment pivots only very slightly, the conduit moves and bends only a very slight amount to avoid detrimental effects. An opening 139 extends coaxially from the drilling fluid conduit 135 in a position adapted to be aligned with the drilling fluid passage 60 in the drill collar 48'. Drilling fluid conducted through the center opening 60 of the drill string passes through the hinged connector apparatus 120 into the drill bit even when the lower body segment is pivoted. The drilling fluid is emitted in the conventional manner by the drill bit to remove the particle cuttings from the drill face and gage corner and wash those particles and cuttings from the borehole.

Each pressurized hydraulic pulse forces the piston member 131 to a projected (downward) position impacting against the upper flat surface 127 of the lower body segment and pivots the lower body segment and connected drill bit slightly about the hinge pin 125, clockwise as shown in FIG. 13. The cutting elements of the drill bit vertically below and diametrically opposite the hinge pin 125 are forced into more substantial engaging cutting contact with the gage corner, when the drill bit pivots. Simultaneously, the cutting elements of the drill bit at a point vertically below the hinge pin experience a reduced amount of contact with the gage corner. The hinge point at the hinge pin 125 is positioned axially as close as possible to the drill bit and drill face for the purpose of maximizing the axial component and force applied on the selected partial arc and minimizing the axial component of force applied to the remaining partial arc. Thus, as the drill bir rotates, the pressure pulse forces the cutting elements of the rotary drill bit into more substantial cutting contact with the gage corner material over the selected partial arc of the circumference of the gage corner, and the cutting elements of the drill bit cause a reduced cutting effect on the remaining partial arc of the circumference of the gage corner. In this manner, a greater amount of material is removed over the preselected arc than that amount of material removed over the remaining partial arc of the gage corner.

The different amount of material is removed during the duration of the pressure pulse which extends the piston member and thereby pivots the lower body segment 124. The duration and the beginning and ending points of the pressure pulse are correlated to rotational position to the drill string and drill bit in the manner previously described in conjunction with the control and energy deriving arrangement. The different amount of gage corner material removed over the selected partial arc and during each of a number of drill bit revolutions, creates the resulting slight lateral force to urge the drill bit to a desired and controlled advancement angle.

PIVOTABLE SINGLE CUTTER WHEEL

A rotary drill bit 150 shown in FIGS. 15 and 16 includes gage corner removal means in the form of a single cutter wheel member 151 mounted for rotation on a bit support structure 152 and adapted to be pivoted in a manner to remove a different amount of the gage corner material than normally removed. The cutting wheel 151 includes a wheel portion 153 and an axle portion 154 extending normally from the wheel portion. The axle portion 154 is received within an opening 155 formed in the support structure 152. The opening 155 is slightly larger than the diameter of the axle portion 154. A plurality of ball bearings 156 are received within ball bearing races 157 and 158 formed respectively in the axle portion 154 and the bit support structure 152. The ball bearings 156 and races 157 and 158 form one means for rotatably connecting the cutter wheel 151 to the bit structure. The loading opening by which the ball bearings 156 are inserted in the races is not shown.

The lower end 159 of the bit support structure is of a curved shape similar to a portion of a spherical surface. A bearing material inlay 160 is bonded to the curved end portion 159 and finished to a spherical shape. A surface 161 of the wheel portion 153 is of curved shape which corresponds to the spherical shape of the finished bearing material inlay 160. The bearing material inlay and the curved surface 161 contact one another and form bearing surfaces to hold the single cutter wheel 151 in firm engagement with the bit structure during contact with the drill face 22. Wear-resistant cutting elements 163 are attached to a surface 164 of the wheel portion 153 in a manner to contact and cut and remove particles of material from the drill face 22 and gage corner 23.

The bearing surfaces 160 and 161 and the ball bearing assembly 156–158 position the cutter wheel 151 on the drill structure 152 in a predetermined manner. The axle portion 154 extends at an intersecting angle with respect to an axial reference through the rotational center of the bit structure (FIG. 15) and in spaced parallel relation with respect to a radial reference from the rotational center of the bit structure (FIG. 16). The parallel offset radial relation positions the cutter wheel 151 in an offset manner. The offset geometry causes the cutting elements 163 to cut the gage corner 23 in a manner somewhat similarly to the manner in which a conventional cone assembly of an offset three-cone drill bit forms the gage corner. The intersecting angle with respect to the axial reference is selected to achieve desired drilling effects similar to those known in the art and associated with single wheel drilling cutters of the type disclosed in U.S. Pat. No. 2,336,335 to Zublin.

A piston receiving chamber 165 extends radially inward from the outer periphery of the bit support structure 152. A piston member 166 is slidably received within the piston receiving chamber 165. A cover cap 167 is welded or otherwise securely attached in a fluid-tight manner at the outer periphery of the bit support structure to completely cover and enclose the piston chamber 166. A Bellville spring 168 is positioned between the radial innermost ends of the piston member and chamber. The Bellville spring biases the piston member radially outward to a retracted position. A fluid inlet opening 169 and communication channel 170 communicate with the piston chamber. A conventional connector, not shown, connects the conduit 59 to the inlet opening 169. Pressure pulses conducted into the piston chamber 165 cause the piston member 166 to move radially inward a slight amount to a projected position. The piston member forms one example of extendable means for moving between projected and retracted positions. The piston 166 and chamber 165 arrangement form one example of activation means for moving the piston member between the projected and retracted positions.

A spherical bearing 171 is received with a sperical shaped opening 172 formed in the piston member 166. A cylindrical opening 173 extends at an angle through the spherical bearing 171 and receives the axle portion 154 of the cutter wheel. The cylindrical opening 173 closely fits around the axle portion 154 but allows rotation of the axle member relative to the spherical bearing. The exterior surface of the spherical bearing 171 generally coincides with the shape of the inner surface of the chamber 165, although enough clearance for slight pivoting of the bearing 171 in the opening 172 is provided. A threaded end 175 of the support structure forms means for connecting the drill bit 150 to the endmost drill collar 48' of the drill string.

In operation, energy in the form of pressurized fluid pulses is conducted from the hydraulic pump 53 and through the conductor 59, the inlet opening 169 and the channel 170 to the piston chamber 165. The pressurized fluid forces the piston member 165 radially inward to the projected position, and the spherical bearing 171 moves inward with the piston. The spherical bearing applies lateral movement to the axle portion 154 as the piston travels to the projected position, thus pivoting the axle and wheel portions of the cutter wheel 151. The ball bearing assembly 154–156 allows slight pivotable movement of the axle portion 154, and the opening 155 is of sufficient size to allow slight pivotable movement. The piston member thus forms means for pivoting the axle portion to a slightly lesser intersecting angle with respect to the axial reference.

Upon pivoting of the axle portion 174, clockwise as shown in FIG. 15, the cutting elements 163 at the outer periphery of the wheel surface 164 are forced into more substantial engaging and cutting contact with the gage corner 23. Pivoting the cutter wheel forces the lowermost cutting element 163' laterally outward (to the left in FIG. 15) into the material of the gage corner 23. Additional material is removed as compared to that normally removed from the gage corner in the non-pivoted position. Of course, the wheel surface 161 separates slightly from the bearing material inlay surface 160 during pivoting.

Very slight pivotable movement is sufficient to remove enough material from the gage corner such that, over a sufficient number of subsequent revolutions, acceptable control over the advancement angle is achieved. Although not shown, it is typical practice to employ centering stabilizers around the drill string at positions axially displaced from single cutting wheel drill bits 150. The stabilizers hold the bit support structure approximately in centered position in the borehole and the single cutter wheel 151 can be pivoted slightly to achieve the desired effects as a result.

Maintaining the rolling cutter wheel 151 in the pivoted condition during a predetermined interval of drill bit rotation causes an increased amount of material to be removed from the gage corner over the preselected arc. The angular duration of the preselected arc corresponds with the angular duration during which the cutting wheel 151 is pivoted. During the remaining interval of drill bit rotation the cutting wheel returns to its original non-pivoted position, and only a normal amount of material is removed over the remaining arc of the circumference of the gage corner. In this manner, a different amount of material is removed over the preselected arc as compared to the remaining arc of the gage corner. Of course, the duration of the pressure pulse which pivots the rolling cutter wheel is correlated to an interval of drill string and drill bit rotation, and the beginning and ending points of the pressure pulse are correlated to rotational positions of the drill string and drill bit, in the manner previously described in conjunction with the control and energy deriving arrangement. The different amount of gage corner material removed over the selected arc and during a number of drill bit revolutions, creates the resulting slight lateral force to urge the drill bit to a desired and controlled advancement angle.

From the foregoing description, it is apparent that effective angle changes can be achieved by very small removals of different amounts of material over a selected partial arc of the gage corner circumference, as compared to the material removed from the remaining partial arc of the circumference. Furthermore, the gage corner removal means for removing the different amount of material cooperate with known rotary drill bits to achieve a normal and acceptable rate of drilling penetration as the advancement angle of the borehole is changed or controlled. The control and energy deriving apparatus operates reliably and consistently as an inherent result of drill string rotation. Furthermore, the control and energy deriving apparatus operates in predetermined correlated relationship with a stationary reference, the low side portion of the sidewall, and controls the drill bit relative to the stationary reference to achieve consistent gage corner removal effects from one revolution of the drill bit to the next. It is apparent, therefore, that the present invention significantly advances the development of the art relative to controlling the advancement angles of boreholes cut by rotary drill bits.

Preferred embodiments of the present invention have thus been described with a degree of particularity. It should be understood, however, that the specificity of the present disclosure has been made by way of example, and that changes in details of features may be made without departing from the spirit of the invention.

What I claim is:

1. A rotary drill bit for selectively controlling the advancement angle of a borehole cut by rotating said drill bit against material, comprising:

a bit support structure;

a cutter assembly positioned on said drill bit housing and comprising cutting elements arranged for cutting an axially extending cylindrical sidewall of the borehole, a drill face extending transversely with respect to the sidewall and a gage corner extending circumferentially from the drill face radially outward at an inclination to the sidewall;

extendable means associated said drill bit structure for selectively moving to a projected position and a retracted position;

a cutter member independent of said cutter assembly and attached to said extendable means at a predetermined position for substantially contacting the gage corner material when said extendable means is moved to the projected position and for avoiding substantial contact with the gage corner material when said extendable means is moved to the retracted position; and activation means adapted for selectively moving said extendable means to the projected position during a predetermined interval of drill bit rotation and for selectively moving said extendable means to the retracted position during the remaining interval of drill bit rotation.

2. A rotary drill bit as defined in claim 1 wherein said cutter member comprises:

a rolling cutter wheel attached to said extendable means.

3. A rotary drill bit as defined in claim 2 wherein:

the rolling cutter wheel includes a peripheral cutting edge, the rolling cutter wheel rotates in a plane essentially transverse with respect to an axis of said drill bit, and the rolling cutter wheel is attached to said extendable means in a predetermined position at which the peripheral cutting edge of said rolling cutter wheel is adapted to be essentially in axial alignment with the gage corner material.

4. A rotary drill bit as defined in claim 2 or 3 wherein:

said cutter assembly comprises two radially offset cone cutter assemblies, each of said cone cutter assemblies comprising cutting elements arranged for cutting a borehole in the manner aforesaid;

each of said cone cutter assemblies positioned on said bit support structure to contact the drill face and gage corner at intervals of approximately one-third of the circumference of the borehole from one another; and said extendable means is positioned on said drill bit structure in a predetermined position for operatively contacting the rolling cutter wheel on the gage corner material at a position essentially one-third of the circumference of said gage corner from the positions at which the two cone cutter assemblies contact the gage corner, whereby the two cone cutter assemblies and the rolling cutter wheel are positioned at equally-spaced circumferential intervals.

5. A rotary drill bit as recited in claim 1 wherein said cutter member comprises:

an abrasion shoe member.

6. A rotary drill bit as defined in claim 1 wherein:

said abrasion shoe member is positioned generally in axial alignment with the gage corner material, said abrasion show member includes an abrasion surface of eccentric contour, said extendable means further comprises means for rotating said abrasion shoe member upon movement of said extendable means to the projected position, and whereby movement of said extendable means to the projected position axially extends the abrasion shoe into contact with the gage corner and rotates the eccentric contour of the abrasion surface with respect to the gage corner.

7. A rotary drill bit as defined in claim 5 wherein:

said cutter assembly comprises three radially offset cone cutter assemblies positioned from one another on said bit support structure to contact the drill face and gage corner at essentially equally spaced circumferential intervals, and said abrasion shoe member is positioned intermediate two of said cone cutter assemblies at an outer radial position on said bit support structure.

8. Apparatus for use with a rotary drill bit and a drill string to selectively control the advancement angle of a borehole cut in material, the drill bit comprising cutting elements arranged for cutting an axially extending cylindrical sidewall of the borehole, a drill face of the borehole extending transversely with respect to the sidewall and a gage corner of the borehole extending circumferentially from the drill face radially outward at an inclination to the sidewall, and an improved connector means for connecting said drill bit to the end of said drill string, said connector means comprising:

an upper body segment adapted to be fixed to the end of said drill string, a lower body segment adapted to be fixed to the drill bit, hinge connecting means for hingeably connecting the lower body segment to the upper body segment at a hinged connection point radially offset from a rotational axis reference of said body segments, said hinge connecting means further operatively connecting the upper and lower body segments to resist rotation relative to one another;

extendable means operatively positioned with respect to the hinge connection point for selectively pivoting of the lower segment with respect to the upper segment when activated; and activation means adapted for selectively activating said extendable means during only a predetermined partial interval of one drill bit rotation.

9. An invention as defined in claim 8 wherein said extendable means is operatively positioned intermediate the upper and lower body segments.

10. An invention as defined in claim 8 wherein:

said extendable means is operatively connected between the upper and lower body segments to pivot the lower body segment at a point diametrically opposite the hinge connection point primarily in an axial direction.

11. An invention as defined in claim 10 wherein:

said upper and lower body segments both comprise flat abutting surfaces extending in a plane essentially transversely with respect to the axial reference through said drill string and said drill bit, and the hinged connection point of said hinge connecting means is through said lower body segment at a position axially spaced toward the drill bit from the flat abutting surface of said lower body segment.

12. An invention as defined in claim 11 wherein said hinge connecting means comprises:

a projection member attached at an outer radial position of said upper body segment to project axially from the flat abutting surface, a receptacle extending axially into the flat abutting surface of said lower body segment at an outer corresponding radial position to receive therein the projection member, and a hinge pin extending from the lower body segment through the receptacle and projection member.

13. A rotary drill bit for selectively controlling the advancement angle of a borehole cut by rotating said drill bit against material, comprising:

a bit support structure, a single cutting wheel member having a wheel portion and an axle portion, the axle portion extending from the wheel portion, the wheel portion on the side opposite the axle portion including cutting elements arranged for cutting an axially extending cylindrical sidewall of the borehole and a drill face of the borehole extending essentially transversely with respect to the sidewall and a gage corner of the borehole extending circumferentially from the drill face radially outward at an inclination to the sidewall;

means for rotatably connecting said cutting wheel member to said bit structure, said rotatably connecting means further comprising an opening formed in said support structure and means for attaching the axle portion in said opening with the axle portion extending at an intersecting angle with respect to an axial reference and in spaced parallel relation with respect to a radial reference through the rotational center of said drill bit;

extendable means operatively connected between the axle portion of said cutting wheel and the bit support structure for pivoting the axle portion of said cutting wheel to a slightly lesser intersecting angle with respect to the axial reference through said drill bit when activated; and activation means adapted for selectively activating said extendable means only during a predetermined partial interval of one drill bit rotation.

14. A rotary drill bit as defined in claim 13 wherein said rotatably connecting means further comprises:

a bearing support surface formed on an end of the bit support structure, the bearing support surface on said bit structure defining a predetermined shape; and a support surface formed on said cutter wheel member, the support surface of said cutter wheel member having a predetermined shape corresponding to the predetermined shape of the bearing support surface on said bit structure, the support surface on said cutter wheel member being positioned to contact and rotate against the bearing support surface on said bit structure.

15. A rotary drill bit as defined in claim 14 wherein: the attaching means of said rotatably connecting means comprises bearing assembly operatively connected between the axle shaft portion and the opening formed in said bit support structure.

16. A rotary drill bit as defined in claim 15 wherein said bearing assembly comprises a plurality of ball bearing members.

17. A rotary drill bit as defined in claim 15 wherein said extendable means is operatively connected to move an end of said axle portion spaced from the wheel portion of said cutting wheel member towards the axial reference of said drill bit.

18. A rotary drill bit as defined in claim 17 wherein said extendable means is connected for movement in a direction parallel to a radial reference from said drill bit.

19. A rotary drill bit as defined in claims 1, 8 or 13 wherein said activation means comprises:

a piston member, supporting structure defining a chamber for slideably receiving said piston member therein, fluid inlet means communicating with said chamber through which fluid pressure exerts force on said piston member to move said piston member.

20. An invention as defined in claims 1, 8, or 13 wherein said activation means comprises:

an electrically energized solenoid having an armature member adapted for moving upon electrical current flowing through said solenoid.

21. A rotary drill bit as defined in claim 19 wherein said extendable means further comprises bias means for forcing said piston in the direction opposite of the fluid pressure force exerted.

* * * * *